US008935812B2

(12) United States Patent
Safford

(10) Patent No.: US 8,935,812 B2
(45) Date of Patent: Jan. 20, 2015

(54) GLOVE WITH IMPACT GUARD

(71) Applicant: Mechanix Wear, Incorporated, Valencia, CA (US)

(72) Inventor: Kenny Safford, Simi Valley, CA (US)

(73) Assignee: Mechanix Wear, Incorporated, Valencia, CA (US)

( * ) Notice: Subject to any disclaimer, the term of this patent is extended or adjusted under 35 U.S.C. 154(b) by 0 days.

(21) Appl. No.: 13/918,700

(22) Filed: Jun. 14, 2013

(65) Prior Publication Data

US 2013/0276199 A1 Oct. 24, 2013

Related U.S. Application Data

(63) Continuation of application No. 13/156,175, filed on Jun. 8, 2011, now Pat. No. 8,490,217.

(51) Int. Cl.
*A41D 19/015* (2006.01)

(52) U.S. Cl.
CPC ..... *A41D 19/01523* (2013.01); *A41D 19/015* (2013.01)
USPC ..... 2/161.6; 2/163

(58) Field of Classification Search
CPC ..... A41D 19/015; A41D 19/01523; A41D 13/087; A41D 13/084; A63B 71/141; A63B 71/143
USPC ..... 2/161.6, 161.1, 161.2, 161.3, 161.8, 2/163, 159, 16, 20, 164, 21, 160, 161.5
See application file for complete search history.

(56) References Cited

U.S. PATENT DOCUMENTS

| | | | | |
|---|---|---|---|---|
| 3,348,238 | A | 10/1967 | Hydock | |
| 3,882,548 | A | 5/1975 | Shinagawa et al. | |
| 3,918,096 | A | 11/1975 | Lim | |
| 4,094,014 | A | 6/1978 | Schroeder | |
| D248,898 | S | 8/1978 | DeLeone et al. | |
| 4,570,269 | A * | 2/1986 | Berlese | 2/16 |
| 4,590,625 | A | 5/1986 | Keim | |
| D287,424 | S * | 12/1986 | Berlese | D29/123 |
| D288,981 | S | 3/1987 | Hale | |
| 4,768,234 | A | 9/1988 | Yamamoto | |
| 4,864,659 | A * | 9/1989 | Morris | 2/20 |
| 4,911,433 | A | 3/1990 | Walker et al. | |
| 5,067,175 | A | 11/1991 | Gold | |
| 5,423,089 | A | 6/1995 | Chun et al. | |
| 5,604,934 | A | 2/1997 | Willett | |
| 6,405,380 | B1 | 6/2002 | Kuroda et al. | |
| 6,415,445 | B1 | 7/2002 | Nishijima et al. | |
| D461,620 | S | 8/2002 | Bevier | |
| D490,966 | S | 6/2004 | Sasaki | |

(Continued)

FOREIGN PATENT DOCUMENTS

KR 3004 16270 6/2006

*Primary Examiner* — Amy Vanatta
(74) *Attorney, Agent, or Firm* — Knobbe, Martens, Olson & Bear, LLP

(57) ABSTRACT

A glove has a top panel and a bottom panel that together form a main glove body. Fingers, including an index finger and other fingers, extend from the main glove body, each of the fingers having a top side and a bottom side corresponding with the top panel and bottom panels of the main glove body. A thumb extends from the main glove body. A region, at a juncture of the index finger and the main glove body on or adjacent the top panel and/or the thumb, has an insulating pad covering a portion of the region.

30 Claims, 2 Drawing Sheets

(56) References Cited

U.S. PATENT DOCUMENTS

| | | | | |
|---|---|---|---|---|
| 7,337,474 | B1 | 3/2008 | Godson | |
| D608,978 | S | 2/2010 | Votel | |
| D653,427 | S | 2/2012 | Wong | |
| D696,467 | S * | 12/2013 | Nelson | D29/117.1 |
| 2007/0245453 | A1 | 10/2007 | Dolenak | |
| 2008/0263747 | A1 | 10/2008 | DeBlasis et al. | |
| 2009/0229035 | A1 | 9/2009 | Van Hale | |
| 2011/0088139 | A1 | 4/2011 | Travell | |
| 2011/0107498 | A1 | 5/2011 | Chang | |

* cited by examiner

GLOVE WITH IMPACT GUARD

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application is a continuation of U.S. patent application Ser. No. 13/156,175, filed Jun. 8, 2011, entitled "Glove with Index Finger Grip and Impact Guard." The contents of the above-referenced application are incorporated herein by reference in their entireties.

BACKGROUND OF THE INVENTION

1. Field of the Invention

This invention relates generally to gloves, and more particularly to a protective glove that is particularly adapted for use in tight spaces.

2. Description of the Related Art

Protective gloves are known in the art, including gloves that include various forms of protective panels and ridges for protecting the back of the user's hand. For example, Shinagawa, U.S. Pat. No. 3,882,548, teaches a glove with protective ridges that extend down the backs of all of the fingers to a traverse region that protects the knuckles of the user. Importantly, when a glove includes such protective ridges, the extend down all of the fingers, including the index finger, and the knuckle protecting traverse region extends all the way across the back of the glove to the index finger.

The disadvantage of such a glove construction is that the protective ridges are thick enough to impede work in confined spaces. The protective ridge on the index finger, and in a region around the index finger and the thumb, especially impedes work in a confined space. The above-described reference is hereby incorporated by reference in full.

The prior art teaches protective gloves that include protective ridges on all fingers, or on none. However, the prior art does not teach a glove that includes protective ridges on fingers excluding the index finger, but leave the index finger unencumbered. The prior art also does not teach the inclusion of an insulating pad in the region, to protect the user from burns in the critical region. The present invention fulfills these needs and provides further related advantages as described in the following summary.

SUMMARY OF THE INVENTION

The present invention teaches certain benefits in construction and use which give rise to the objectives described below.

The present invention provides a glove for protecting a hand. The glove comprises a top panel for covering a back of the hand; a bottom panel for covering a palm of the hand, the top and bottom panels being connected to form a main glove body; fingers, including an index finger and other fingers, extending from the main glove body, each of the fingers having a top side and a bottom side corresponding with the top panel and bottom panels of the main glove body; and a thumb extending from the main glove body. A region, at a juncture of the index finger and the main glove body on or adjacent the top panel and/or the thumb, has an insulating pad covering a portion of the region.

A primary objective of the present invention is to provide a glove having advantages not taught by the prior art.

Another objective is to provide a glove that includes an insulating pad over a region of the glove that is particularly susceptible to injury.

A further objective is to provide a glove that includes an index finger that does not include protrusions, so that the index finger may be inserted into tight places without hindrance from the glove.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENT

The above-described drawing figures illustrate the invention, a glove for protecting a hand of a user. The glove particularly well adapted for working in tight places, and includes a specially configured index finger having an insulating pad operatively positioned to protect the user's hand without interfering with the use of the index finger within the tight place.

Figure 1:
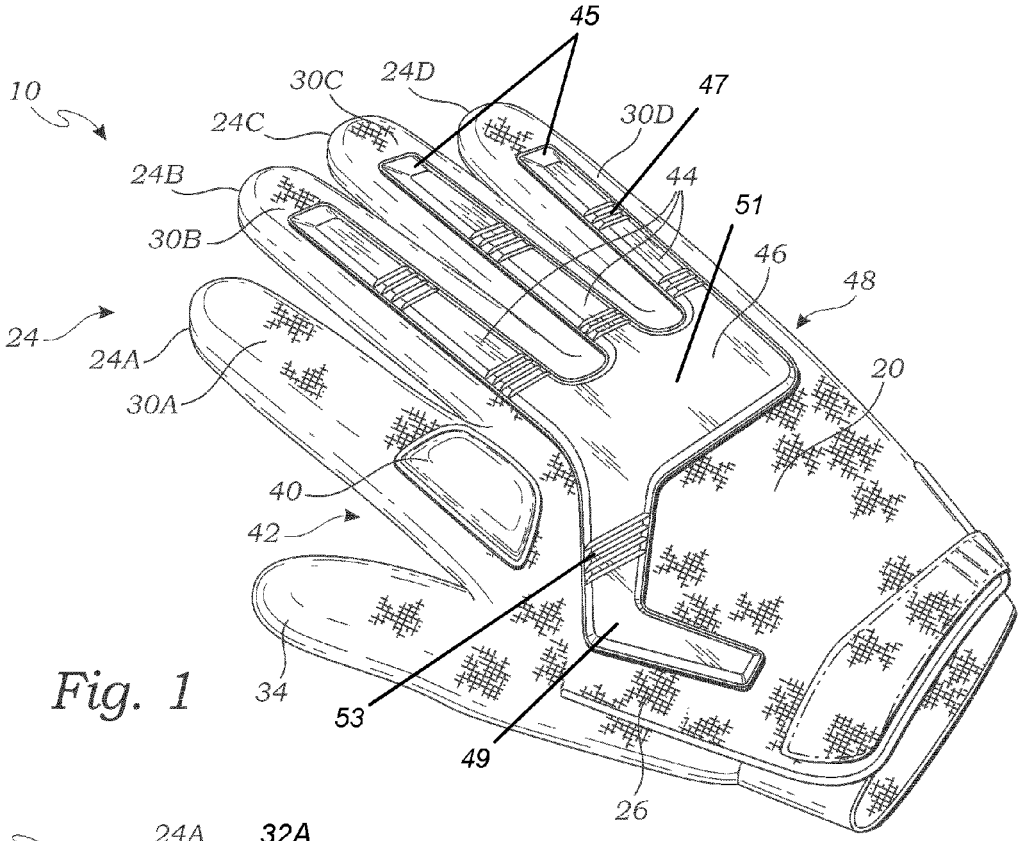
FIG. 1 is a top perspective view of a glove according to one embodiment of the present invention.
Figure 2:
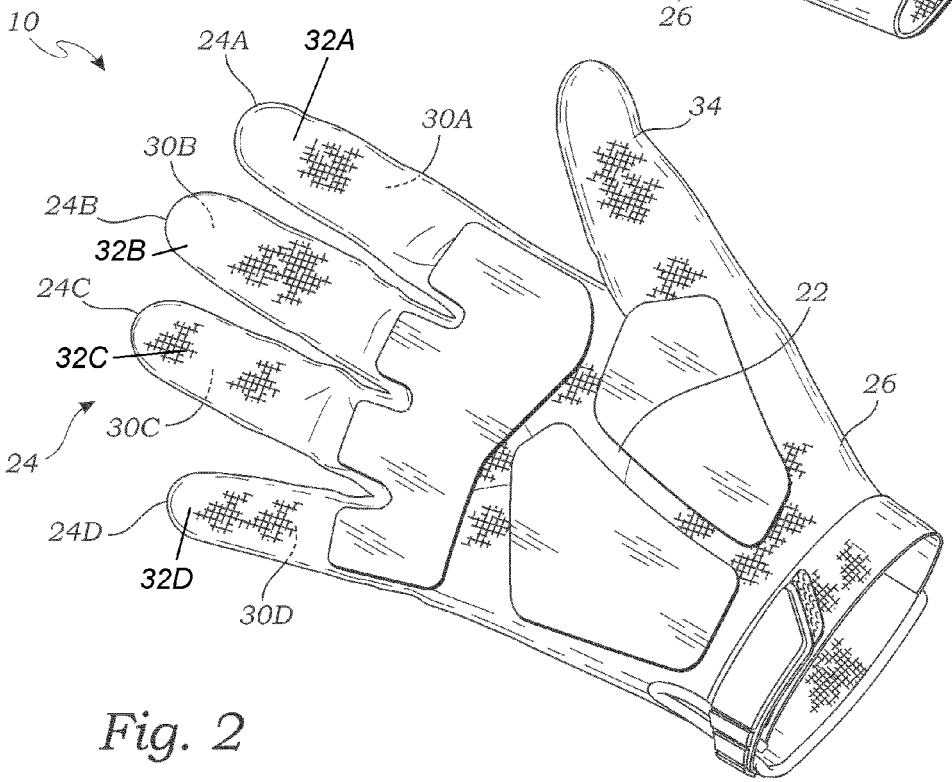
FIG. 2 is a bottom perspective view thereof.
Figure 3:
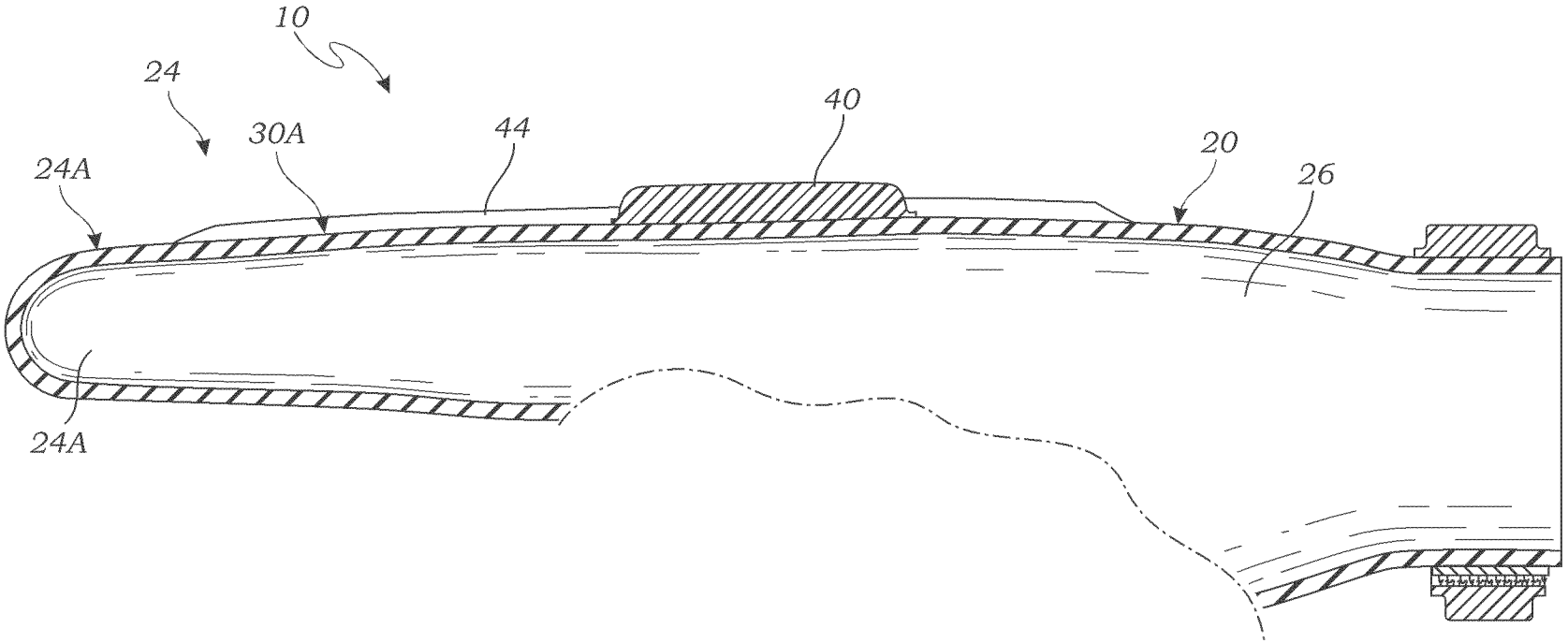
FIG. 3 is a side sectional view of an index finger of the glove, illustrating an insulating pad of the glove.

FIG. 1 is a top perspective view of the glove 10 according to one embodiment of the present invention. FIG. 2 is a bottom perspective view thereof. As shown in FIGS. 1-2, the glove 10 includes a top panel 20 for covering a back of the hand, an opposed bottom panel 22, and fingers 24. FIG. 3 is a side sectional view of an index finger 24A of the glove 10, illustrating an insulating pad 40 of the glove 10.

As illustrated in FIGS. 1-4, the top panel 20 is shaped and constructed for covering a back of the hand. The bottom panel 22 is shaped and constructed for covering a palm of the hand. The top and bottom panels 22 are connected (e.g., sewn) to form a main glove body 26. The fingers 24, including an index finger 24A and other fingers 24B, 24C, and 24D, extend from the main glove body 26 and are shaped to each receive a finger of the hand. Each of the fingers 24 includes a top side 30A, 30B, 30C, and 30D and a bottom side 32A, 32B, 32C, and 32D corresponding with the top panel 20 and bottom panels 22 of the main glove body 26. A thumb 34 extends from the main glove body 26 shaped to accommodate the user's thumb 34. The general construction of the glove 10 is similar to prior art gloves 10, and is therefore not discussed in greater detail.

Critical to the invention is the insulating pad 40 positioned within a region 42 at a juncture of the index finger 24A and the main glove body 26 on or adjacent the top panel 20 and/or the thumb 34. In one embodiment, the insulating pad 40 is a rubberized grip insert that is sewn, bonded, or otherwise attached to the region 42 of the glove 10. The insulating pad 40 is positioned to protect the user's hand from damage, and in particular from burns, when the user is inserting his or her hand into a tight location that might have elements that are hot (e.g., inside an engine, etc.). In one embodiment, the insulating pad 40 does not extend beyond the region 42, but is only positioned within the region 42 for protecting the user from injuries particular to this region 42. In the preferred embodiment, the insulating pad 40 is positioned over the proximal phalange of the user's index finger, and does not extend to the medial phalange or the metacarpal of the user's hand.

To further protect the user's hand, the glove 10 may further include thermoplastic or molded rubber protective ridges 44 extending upwardly from the top panel 20 of each of the other fingers 24B, 24C, and 24D. However, it is preferred that the index finger 24A not include such a protective ridge 44. The protective ridge can have a width that is smaller than a width of a top side of the associated finger. The protective ridge can have a length extending least two-thirds or at least three-fourths the length of the associated finger. The protective ridge 44 has a distal end comprising a sloped edge 45 sloping from a top surface of the protective ridge toward a top side of the finger such that the distal end has a smaller thickness than a more proximal portion. The protective ridge 44 can have one or more flex points 47, which flex points 47 can be comprised of a plurality of grooves formed in the protective ridge 44.

In the embodiment of FIG. 1, the glove 10 further includes a knuckle protector 46 extending across a knuckle region 48 of the top panel 20. The knuckle panel may be integrally formed with the protective ridges 44 of the other fingers 24B, 24C, and 24D, but preferably does not extend into the region 42 of the insulating pad 40. The knuckle protector 46 comprises an extension away from the fingers, the extension comprising a first portion 49 extending in a direction that is substantially orthogonal to a direction of the thumb and a second portion 51 extending from the first portion in a direction that is generally parallel to at least one of the fingers. The knuckle protector can include one or more flex points 53 that can comprise a plurality of grooves formed in the knuckle protector 46.

In this manner, the index finger 24A of the glove 10 does not include protrusions that extend outwardly from the glove 10 in a manner that might restrict use of the glove 10 in tight spaces; and yet the insulating pad 40, carefully positioned in the region 42 specified, operates to protect the user from injury and burns in this region 42 that is particularly susceptible to injury when being used in this manner.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A glove for protecting a hand, the glove comprising:

a top panel that is adapted to cover a back of the hand;

a bottom panel that is adapted to cover a palm of the hand, the top panel and the bottom panel being connected to form a main glove body;

fingers, including an index finger and other fingers, extending from the main glove body, each of the fingers having a top side and a bottom side corresponding with the top panel and bottom panel of the main glove body;

a thumb extending from the main glove body;

a protective ridge extending upwardly from the top side of at least one of the other fingers;

the protective ridge having a width that is smaller than a width of the top side of the at least one of the other fingers with which the protective ridge is associated, the protective ridge stopping short of the end of the at least one of the other fingers with which the protective ridge is associated and having one or more transverse interruptions positioned at a flex point adapted to overlie a knuckle in use, and the thumb and the index finger not including a protective ridge.

2. The glove of claim 1, wherein the protective ridge comprises at least one of a thermoplastic material or a molded rubber material.

3. The glove of claim 1, wherein the protective ridge has a distal end, the distal end comprising a sloped edge sloping from a top surface of the protective ridge toward the top side of the finger such that the distal end has a smaller thickness than a more proximal portion.

4. The glove of claim 1, wherein each one of the other fingers has a respective length and the protective ridge extending upwardly from the top side of the other fingers extends at least two-thirds the length of the associated other finger.

5. The glove of claim 4, wherein the protective ridge extending upwardly from the top side extends at least three-fourths the length of the associated other finger.

6. The glove of claim 1, wherein the protective ridge includes two flex points.

7. The glove of claim 6, wherein one or more of the two flex points comprises a plurality of grooves formed in the protective ridges.

8. The glove of claim 1, further comprising a knuckle protector extending across a knuckle region of the top panel.

9. The glove of claim 8, wherein the knuckle protector interconnects three protective ridges.

10. The glove of claim 8, wherein the knuckle protector further comprises an extension away from the fingers, the extension comprising:

a first portion extending from the knuckle protector in a direction that is substantially orthogonal to a direction of the thumb; and a second portion extending from the first portion in a direction generally parallel to at least one of the fingers.

11. The glove of claim 10, wherein the knuckle protector includes one or more flex points.

12. The glove of claim 11, wherein the one or more flex points comprise a plurality of grooves formed in the knuckle protector.

13. The glove of claim 8, wherein the knuckle protector comprises at least one of a thermoplastic material or a molded rubber material.

14. The glove of claim 8, wherein the knuckle protector is integrally formed with one or more of the protective ridges.

15. The glove of claim 14, wherein all of the other fingers include a protective ridge.

16. A glove for protecting a hand, the glove comprising a top panel adapted to cover a back of the hand, a bottom panel adapted to cover a palm of the hand, the top panel and the bottom panel being connected to form a main glove body, a thumb and four fingers extending distally away from the main glove body, the four fingers comprising an index finger, a middle finger, a ring finger and a pinky finger, each of the four fingers comprising a top side and a bottom side that correspond to the top panel and the bottom panel of the main glove body, a thermoplastic or molded rubber protective ridge extending along the top side of each of the middle finger, the ring finger and the pinky finger such that three protective ridges extend along the top sides of three fingers, each of the three protective ridges being subdivided into three regions by two flex points, the flex points being defined by a plurality of grooves that extend transversely across the associated ridge, a knuckle protector extending across a knuckle region of the top panel of the main glove body, the knuckle protector being monolithic with the protective ridges such that the three protective ridges are interconnected by the knuckle protector, the knuckle protector also comprising an extension portion that extends toward a cuff portion of the glove in a region between a base of the index finger and the cuff portion, the extension portion comprising a flex point comprising a plurality of transversely extending grooves, and a pad being positioned along the top side of the index finger and being separate of the knuckle protector.

17. A glove for protecting a hand, the glove comprising:

a top panel that is adapted to cover a back of the hand;

a bottom panel that is adapted to cover a palm of the hand, the top panel and the bottom panel being connected to form a main glove body;

fingers, including an index finger and other fingers, extending from the main glove body, each of the fingers having a top side and a bottom side corresponding with the top panel and bottom panel of the main glove body;

a thumb extending from the main glove body;

a protective ridge extending upwardly from the top side of at least one of the other fingers, the protective ridge having a width that is smaller than a width of the top side of the at least one of the other fingers with which the protective ridge is associated, and the thumb and the index finger not including a protective ridge; and a knuckle protector extending across a knuckle region of the top panel, wherein the knuckle protector further comprises an extension away from the fingers, the extension comprising:

a first portion extending from the knuckle protector in a direction that is substantially orthogonal to a direction of the thumb; and a second portion extending from the first portion in a direction generally parallel to at least one of the fingers.

18. The glove of claim 17, wherein the knuckle protector includes one or more flex points.

19. The glove of claim 18, wherein the one or more flex points comprise a plurality of grooves formed in the knuckle protector.

20. The glove of claim 17, wherein the protective ridge comprises at least one of a thermoplastic material or a molded rubber material.

21. The glove of claim 17, wherein the protective ridge has a distal end, the distal end comprising a sloped edge sloping from a top surface of the protective ridge toward the top side of the finger such that the distal end has a smaller thickness than a more proximal portion.

22. The glove of claim 17, wherein each one of the other fingers has a respective length and the protective ridge extending upwardly from the top side of the other fingers extends at least two-thirds the length of the associated other finger.

23. The glove of claim 22, wherein the protective ridge extending upwardly from the top side extends at least three-fourths the length of the associated other finger.

24. The glove of claim 17, wherein the protective ridge includes one or more flex points.

25. The glove of claim 24, wherein one or more of the one or more flex points comprises a plurality of grooves formed in the protective ridges.

26. The glove of claim 25, wherein each of the protective ridges includes multiple flex points and each of the multiple flex points comprises multiple grooves.

27. The glove of claim 17, wherein the knuckle protector interconnects three protective ridges.

28. The glove of claim 17, wherein the knuckle protector comprises at least one of a thermoplastic material or a molded rubber material.

29. The glove of claim 17, wherein the knuckle protector is integrally formed with one or more of the protective ridges.

30. The glove of claim 29, wherein all of the other fingers include a protective ridge.

* * * * *